US012247382B2

(12) United States Patent
Goudreau et al.

(10) Patent No.: US 12,247,382 B2
(45) Date of Patent: Mar. 11, 2025

(54) SYSTEM AND METHOD FOR A LOW FLUSH TOILET SYSTEM

(71) Applicant: Strategic Water Solutions Holdings, LLC, Bloomington, MN (US)

(72) Inventors: Paul Michael Goudreau, Hopkins, MN (US); Andrew Nathaniel Smith, Hopkins, MN (US); Tyler Lorne Hebig, Hopkins, MN (US); Michael Wade Strawn, Hopkins, MN (US); Justin Magoline, Hopkins, MN (US); David Arguelles, Hopkins, MN (US)

(73) Assignee: Strategic Water Solutions Holdings, LLC, Bloomington, MN (US)

( * ) Notice: Subject to any disclaimer, the term of this patent is extended or adjusted under 35 U.S.C. 154(b) by 266 days.

(21) Appl. No.: 18/080,911

(22) Filed: Dec. 14, 2022

(65) Prior Publication Data

US 2023/0392362 A1 Dec. 7, 2023

Related U.S. Application Data

(60) Provisional application No. 63/347,866, filed on Jun. 1, 2022.

(51) Int. Cl.

| | |
|---|---|
| ***E03D 3/10*** | (2006.01) |
| ***E03D 1/26*** | (2006.01) |
| ***E03D 1/30*** | (2006.01) |
| ***E03D 1/32*** | (2006.01) |
| ***E03D 5/10*** | (2006.01) |

(52) U.S. Cl.

CPC ..... *E03D 3/10* (2013.01); *E03D 1/266* (2013.01); *E03D 1/304* (2013.01); *E03D 1/32* (2013.01); *E03D 5/10* (2013.01)

(58) Field of Classification Search

CPC ..... E03D 3/10; E03D 1/266; E03D 1/304; E03D 1/32; E03D 5/10

USPC ..... 4/345, 354–363, 337, 380, 332, 334

See application file for complete search history.

(56) References Cited

U.S. PATENT DOCUMENTS

| | | | | |
|---|---|---|---|---|
| 880,594 A * | 3/1908 | Stickdorn | ..... | E03D 3/10 4/359 |
| 4,955,921 A | 9/1990 | Basile et al. | | |
| 5,005,226 A * | 4/1991 | Basile | ..... | E03D 3/10 4/354 |

(Continued)

OTHER PUBLICATIONS

"International Search Report and Written Opinion of the International Searching Authority," issued in connection with Int'l Appl. No. PCT/US2023/067639, dated Sep. 19, 2023.

*Primary Examiner* — Tuan N Nguyen

(74) *Attorney, Agent, or Firm* — Holland & Hart LLP

(57) ABSTRACT

The disclosed technology includes a tank system including a gravity tank configured to contain water at atmospheric pressure, a rigid pressurized tank positioned within the gravity tank and configured to contain water at a pressure greater than atmospheric pressure, and a piston assembly positioned below the rigid pressurized tank and configured to open and close the rigid pressurized tank. The gravity tank is configured to channel water at atmospheric pressure into a toilet bowl at a first velocity and the rigid pressurized tank is configured to channel water at the pressure greater than atmospheric pressure into the toilet bowl at a second velocity. The second velocity is greater than the first velocity.

15 Claims, 6 Drawing Sheets

(56) References Cited

U.S. PATENT DOCUMENTS

| | | | | |
|---|---|---|---|---|
| 5,115,521 | A * | 5/1992 | Adamides | E03D 3/10 4/354 |
| 2005/0150038 | A1 | 7/2005 | Li | |
| 2018/0073231 | A1 | 3/2018 | Smith et al. | |
| 2020/0115889 | A1 | 4/2020 | Kuru et al. | |
| 2021/0040717 | A1 | 2/2021 | Kitaura et al. | |

* cited by examiner

SYSTEM AND METHOD FOR A LOW FLUSH TOILET SYSTEM

CROSS-REFERENCE OF RELATED APPLICATION

This application claims the benefit of U.S. Provisional Patent Application No. 63/347,866, filed Jun. 1, 2022, which is incorporated by reference herein in its entirety.

FIELD OF TECHNOLOGY

The present disclosure relates generally to toilets, and more particularly, to low flush toilet systems.

BACKGROUND

Toilets are a top water consuming appliance in residential and commercial buildings. Certain toilet systems include designs that require a large amount of water to flush a toilet bowl, and in some cases, require more than one flush to clear waste from the toilet bowl. Such toilet systems are neither environment-friendly nor economical.

Due to water shortages and water conservation efforts, water efficiency standards have been implemented through various state legislation. For example, in some states, maximum flow rates have been implemented. Low-flush (or high-efficiency) toilet systems use significantly less water than high-flush toilet systems and can reduce water consumption.

SUMMARY

The described technology includes methods, systems, devices, and apparatuses for a tank system for toilets. In some embodiments, the tank system includes a gravity tank configured to contain water at atmospheric pressure, a rigid pressurized tank positioned within the gravity tank and configured to contain water at a pressure greater than atmospheric pressure, and a piston assembly positioned below the rigid pressurized tank and configured to open and close the rigid pressurized tank. The gravity tank is configured to channel water at atmospheric pressure into a toilet bowl at a first velocity and the rigid pressurized tank is configured to channel water at the pressure greater than atmospheric pressure into the toilet bowl at a second velocity. The second velocity is greater than the first velocity.

In some implementations, the toilet includes a toilet bowl and a tank system. The tank system includes a gravity tank configured to contain water at atmospheric pressure, a rigid pressurized tank positioned within the gravity tank and configured to contain water at a pressure greater than atmospheric pressure, and a piston assembly positioned below the rigid pressurized tank and configured to open and close the rigid pressurized tank. The gravity tank is configured to channel water at atmospheric pressure into a toilet bowl at a first velocity and the rigid pressurized tank is configured to channel water at the pressure greater than atmospheric pressure into the toilet bowl at a second velocity. The second velocity is greater than the first velocity.

In some implementations, a method of flushing a toilet is provided. The toilet includes a toilet bowl and a tank system. The tank system includes a gravity tank, a rigid pressurized tank positioned within the gravity tank, an outlet valve positioned within the gravity tank, and a piston assembly attached to the rigid pressurized tank and positioned within the gravity tank. The method includes opening the outlet valve and channeling water at atmospheric pressure into the toilet bowl. The water at atmospheric pressure has a first velocity within the toilet bowl. The method also includes opening the rigid pressurized tank after a first predetermined amount of time and channeling water at a pressure greater than atmospheric pressure into the toilet bowl. The water at the pressure greater than atmospheric pressure has a second velocity within the toilet bowl greater than the first velocity.

This Summary is provided to introduce a selection of concepts in a simplified form that are further described below in the Detailed Description. This Summary is not intended to identify key features or essential features of the claimed subject matter, nor is it intended to be used to limit the scope of the claimed subject matter. Other features, details, utilities, and advantages of the claimed subject matter will be apparent from the following more particular written Detailed Description of various implementations as further illustrated in the accompanying drawings and defined in the appended claims.

These and various other features and advantages will be apparent from a reading of the following Detailed Description.

DETAILED DESCRIPTION

In the following description, for the purposes of explanation, numerous specific details are set forth in order to provide a thorough understanding of the present invention. It will be apparent, however, to one skilled in the art that the present invention may be practiced without some of these specific details. For example, while various features are ascribed to particular implementations, it should be appreciated that the features described with respect to one implementation may be incorporated with some implementations as well. Similarly, however, no single feature or features of any described implementation should be considered essential to the invention, as some implementations of the invention may omit such features.

The disclosed technology includes pressure assist toilet flushing systems and methods. Specifically, in one implementation, a two-tank configuration (e.g., a gravity tank and a pressurized tank) can be applied to an existing toilet system and configured to perform a syphoning flush that uses less water than other pressure-assisted tanks due to a preloading operation of the flushing rim.

More specifically, the pressurized tank may be nested inside of the gravity tank. Further, the pressure tank and the gravity tank may be separate components. Once filled with water from a water supply, the gravity tank is released via the flushing rim of a toilet. The pressure tank includes water at a pressure greater than atmospheric pressure. Once the gravity tank has discharged via the flushing rim, the pressure tank is discharged, and the velocity of the pressurized water is greater than the velocity of the atmospheric water from the gravity tank. Thus, the water from the pressurized tank is more efficient at removing waste from a toilet bowl than typical toilets.

Additionally, the toilet system includes a piston system and a solenoid valve. The piston system is configured to open the pressurized tank using water from the pressurized tank. More specifically, when actuated, the solenoid valve channels pressurized water to the piston system and the piston system uses the water pressure to open the pressurized tank. Thus, the toilet systems described herein use the pressurized water to efficiently open the pressurized tank and are more efficient at removing waste from a toilet bowl than typical toilets.

Finally, the toilet system includes an electric outlet valve, a control system, and a generator. The generator is configured to generate electricity that powers the electric outlet valve, the control system, and the solenoid valve. More specifically, the generator generates electricity from the flow of water from a water source. Thus, the toilet systems described herein electrically control the toilet system without plugging the toilet system into an external source of electricity.

Figure 1:
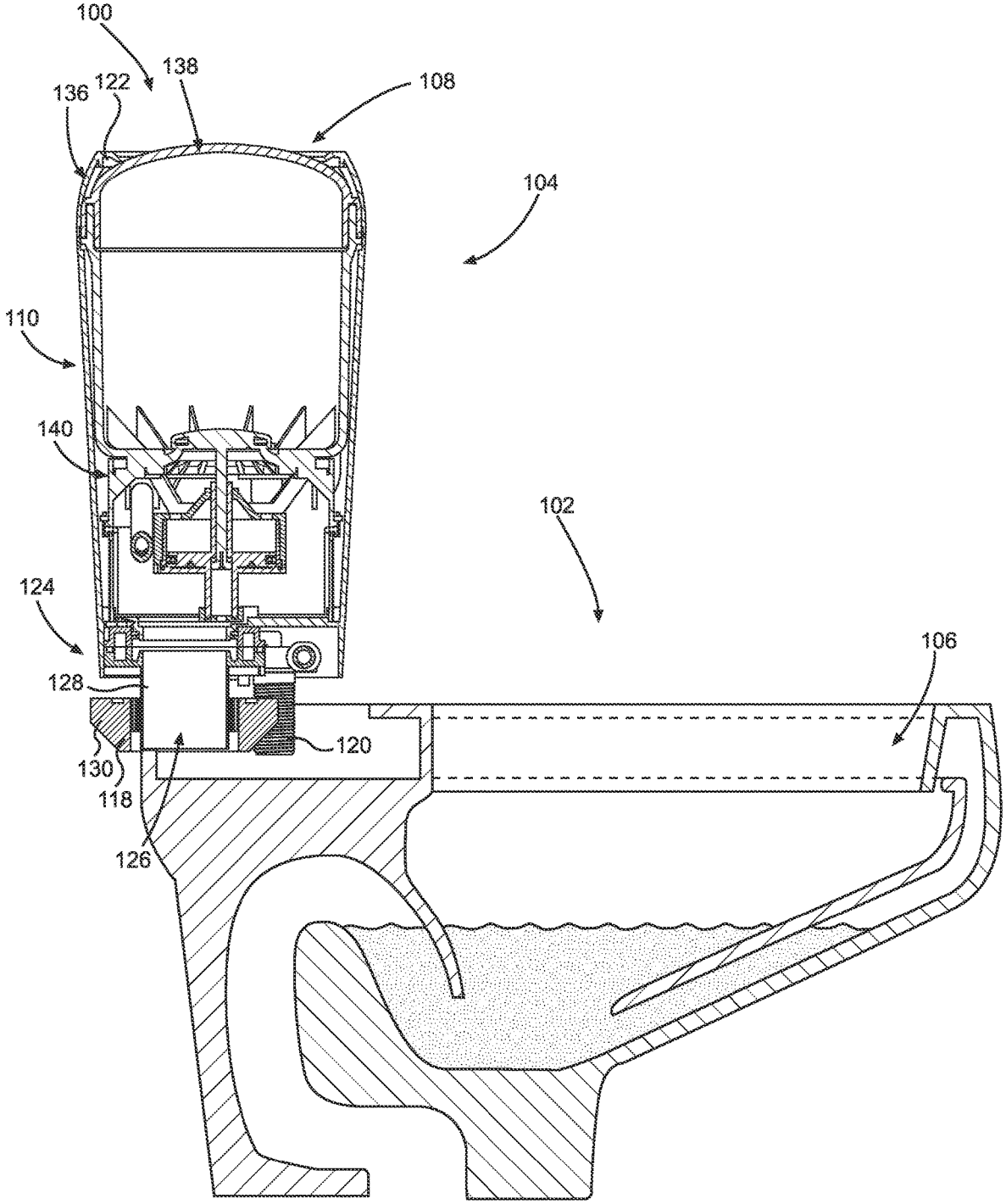
FIG. 1 illustrates an example of a cross-sectional side view of an example low flush toilet system in accordance with aspects of the present disclosure.
Figure 2:
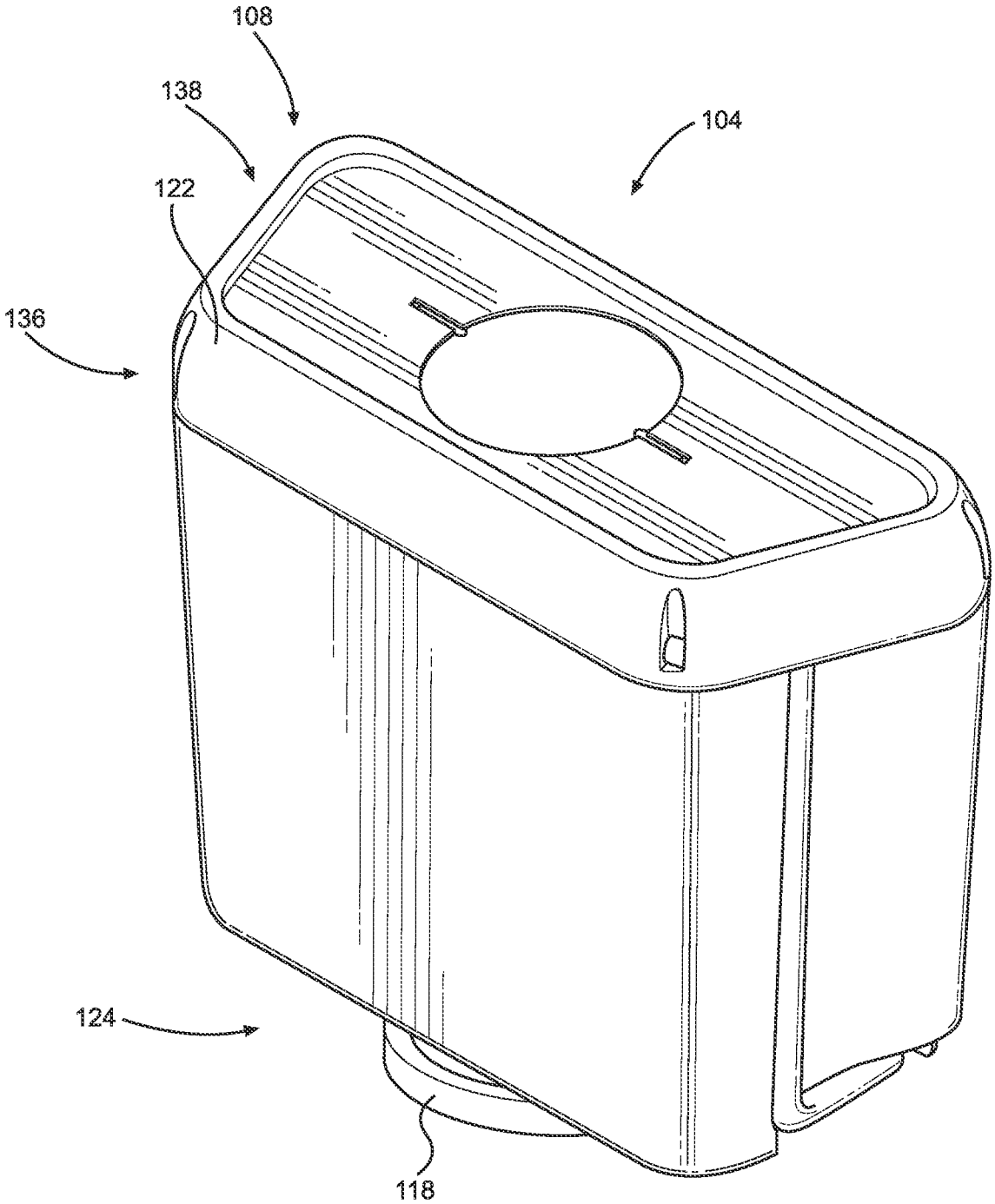
FIG. 2 illustrates an example of a perspective view of a tank system of the low flush toilet system illustrated in FIG. 1 in accordance with aspects of the present disclosure.
Figure 3:
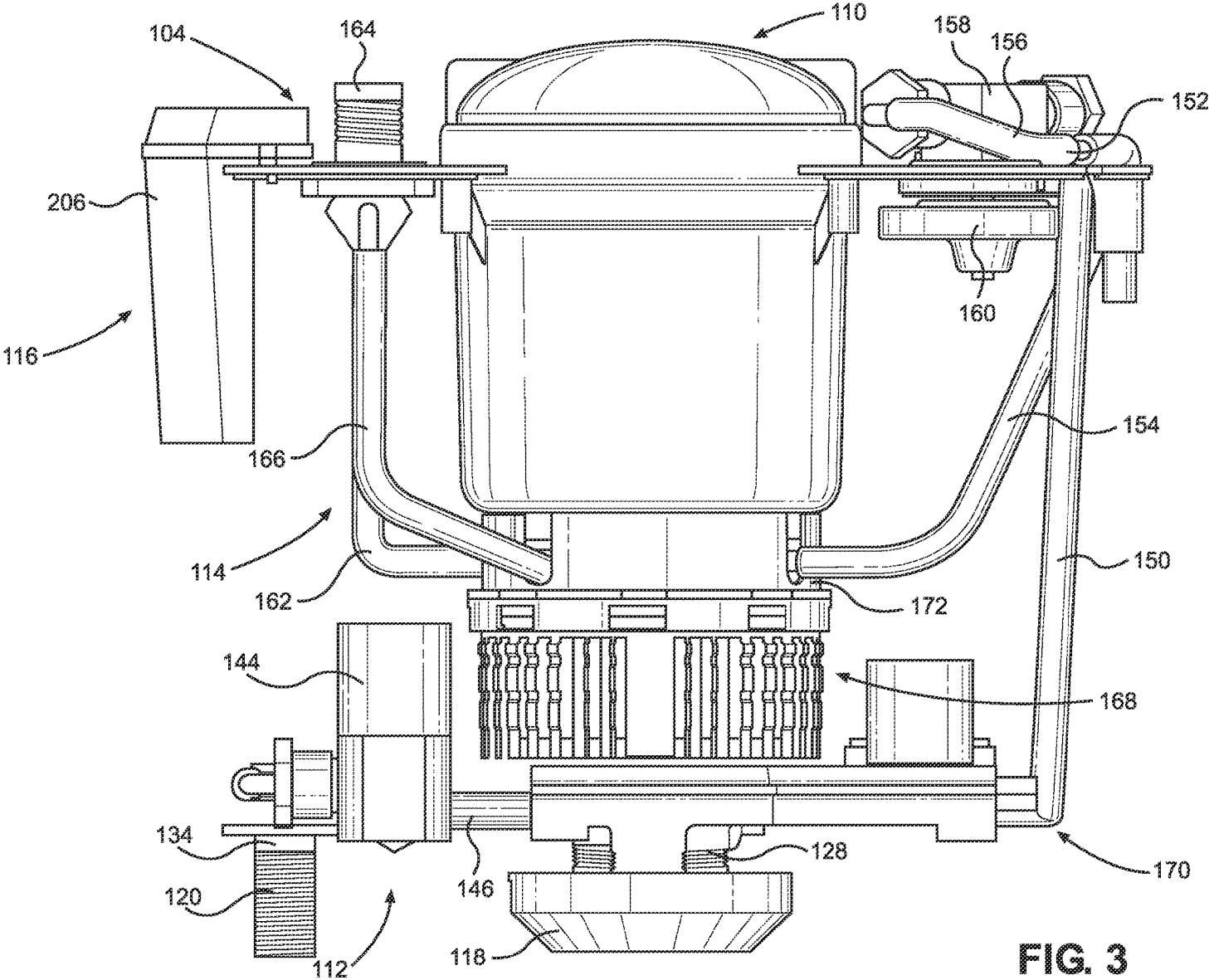
FIG. 3 illustrates an example of a cross-sectional front view of the tank system illustrated in FIG. 2 with a gravity tank and a lid removed for clarity in accordance with aspects of the present disclosure.
Figure 4:
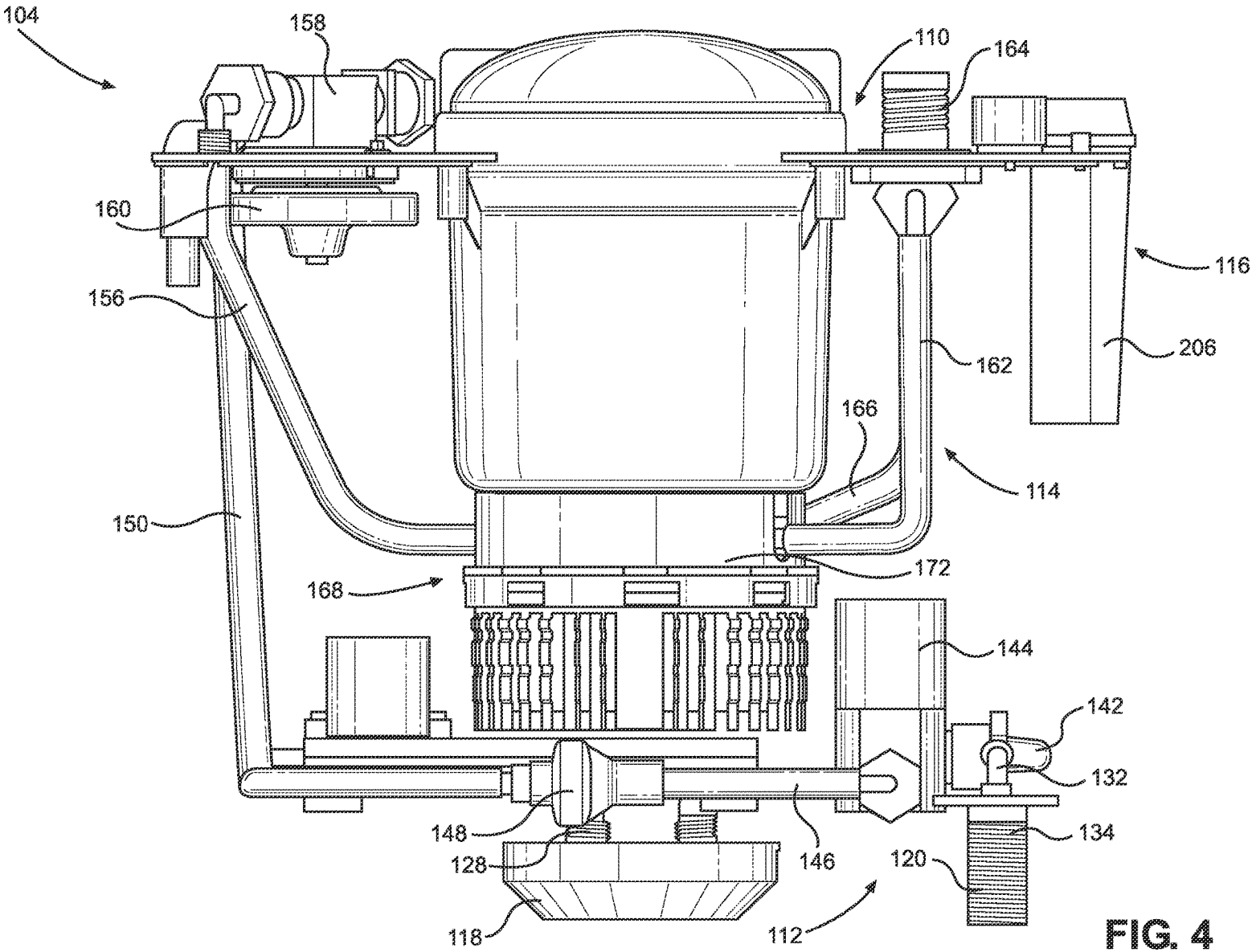
FIG. 4 illustrates an example of a cross-sectional back view of the tank system illustrated in FIG. 2 with the gravity tank and the lid removed for clarity in accordance with aspects of the present disclosure.
Figure 5:
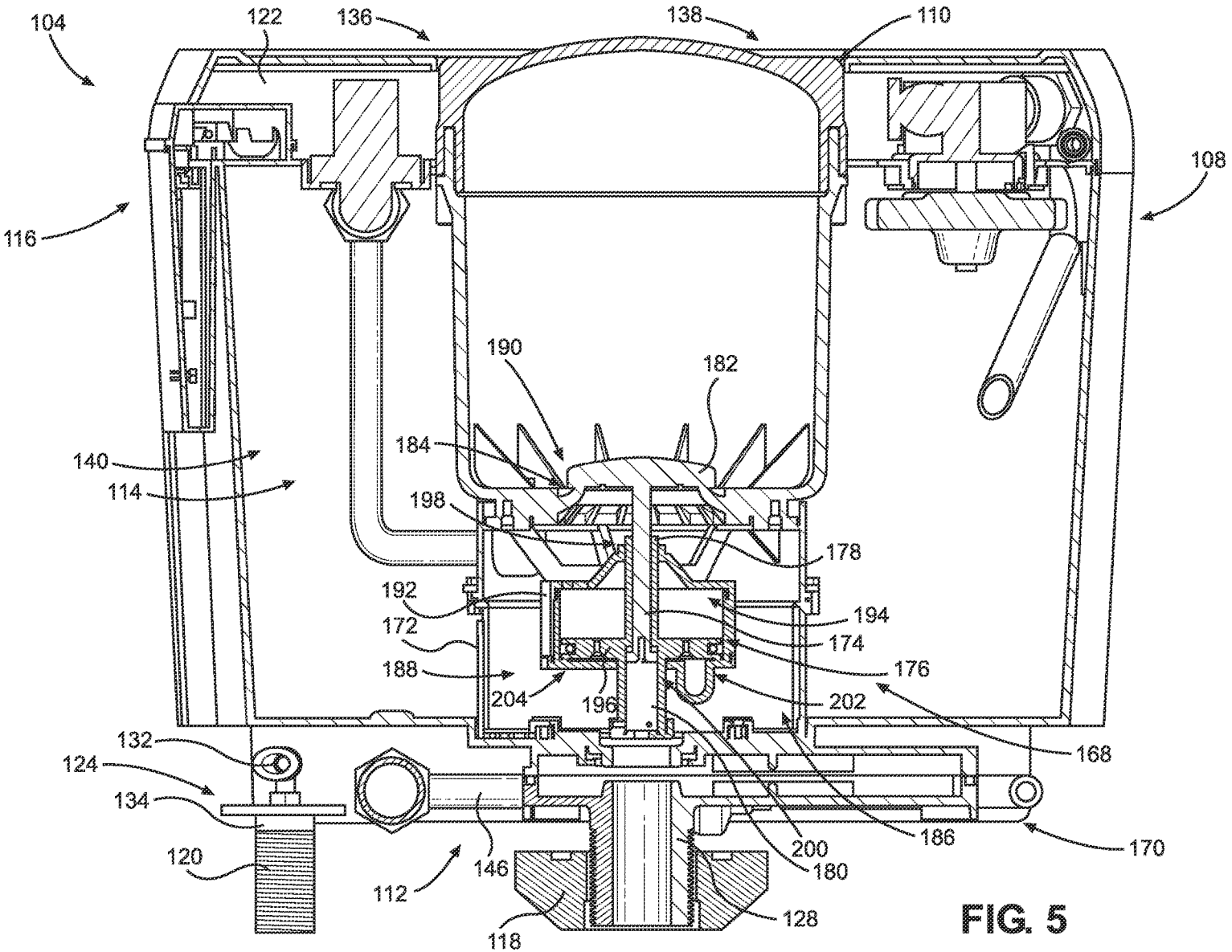
FIG. 5 illustrates an example of a cross-sectional front view of the tank system illustrated in FIG. 2 in accordance with aspects of the present disclosure.

FIG. 1 illustrates a cross-sectional side view of an example low flush toilet system 100. FIG. 2 illustrates a perspective view of a tank system 104. FIG. 3 illustrates a cross-sectional front view of the tank system 104 with a gravity tank 108 and a lid 122 removed for clarity. FIG. 4 illustrates a cross-sectional back view of the tank system 104 with the gravity tank 108 and the lid 122 removed for clarity. FIG. 5 illustrates a cross-sectional front view of the tank system 104.

The low flush toilet system 100 includes a toilet bowl 102 and a tank system 104 positioned on top of and attached to the toilet bowl 102. The toilet bowl 102 includes a flushing rim 106 formed within the toilet bowl 102 for evenly distributing water throughout the toilet bowl 102. The tank system 104 includes a gravity tank 108, a pressurized tank 110, a fill system 112, an evacuation system 114, and a control system 116. As described in greater detail below, the tank system 104 is configured to flush the toilet 100 with less than 1.5 gallons of water per flush. For purposes of this disclosure, the term "low flush" may be defined as a flush that uses substantially less water than normal flushes. For example, a low flush may be about 60% to about 90% of a normal flush or a starting flush volume such that a low flush saves 10% to 40% when compared to a normal flush. For example, a low flush may be a flush that uses less than 1.28 gallons per flush (GPF). The tank system 104 is a low flush tank system because the tank system 104 includes the pressurized tank 110 that is configured to contain pressurized water that, when flushed, has increased velocity within the toilet bowl 102 and more effectively removes waste from the toilet bowl 102 with less water. That is, the pressurized water within the pressurized tank 110 has increased velocity when compared to typical gravity fed toilets and, as such, may be capable of removing waste that is difficult for typical toilets to remove. Accordingly, the low flush toilet systems 100 described herein are low flush because pressurized water is used to flush the toilet such that the overall amount of water per flush is reduced, saving water, and reducing costs.

As shown in FIG. 2, the tank system includes the gravity tank 108, an outlet drain nut 118, an inlet 120, and a lid 122. The gravity tank 108 is configured to contain water that is maintained at atmospheric pressure, the pressure tank 110 (shown in FIG. 3), the fill system 112 (partially illustrated in FIG. 2), the evacuation system 114 (partially illustrated in FIG. 2), and the control system 116 (shown in FIG. 3). The outlet drain nut 118 is part of the evacuation system 114 and is attached to a bottom 124 of the gravity tank 108. The outlet drain nut 118 is also configured to attach the gravity tank 108 to the toilet bowl 102 and seal the gravity tank 108 to the toilet bowl 102 such that a sealed outlet flow path 126 (shown in FIG. 1) is defined through the tank system 104 and the toilet bowl 102. Specifically, the outlet drain nut 118 screws onto an outlet pipe 128 and includes an O-ring 130 that interfaces with the toilet bowl 102 to seal the outlet pipe 128 to the toilet bowl 104. The inlet 120 includes a right-angle adapter 132 that extends through the gravity tank 108 and also includes a ball-cock fitting 134 that connects to a water supply (not shown). A top 136 of the gravity tank 108 defines an opening 138 that permits access to an internal cavity 140 of the gravity tank 108. The lid 122 covers the opening 138 during normal operations.

The fill system 112 is configured to fill the gravity tank 108, fill the pressurized tank 110, generate electricity to power the control system 116, and regulate the pressure in the pressurized tank 110. In the illustrated embodiment, the pressurized tank 110 is a rigid tank configured to contain pressurized water. The fill system 112 includes the inlet 120, a first inlet hose 142, a generator 144, a second inlet hose 146, a pressure regulator 148, a third inlet hose 150, a T-splitter 152, a fourth inlet hose 154, a fifth inlet hose 156, and a float valve 158.

The inlet 120 is attached to a water supply (not shown) and the first inlet hose 142 and is configured to channel water from the water supply to the first inlet hose 142. The first inlet hose 142 is attached to the inlet 120 and the generator 144 and is configured to channel water from the inlet 120 to the generator 144. The generator 144 is attached to the first inlet hose 142 and the second inlet hose 146 and is configured to generate electricity to power the control system 116 and channel water from the first inlet hose 142 to the second inlet hose 146. Specifically, in the illustrated embodiment, the generator 144 includes a turbine (not shown) that is rotated by water and rotates an electric generator (not shown) to generate electricity. In an alternative embodiment, the generator 144 may be any type of generator that enables the low flush toilet system 100 to operate as described herein.

The second inlet hose 146 is attached to the generator 144 and the pressure regulator 148 and is configured to channel water from the generator 144 to the pressure regulator 148. The pressure regulator 148 is attached to the second inlet hose 146 and the third inlet hose 150 and is configured to regulate the pressure of the water channeled to the pressurized tank 110 and channel water from the second inlet hose 146 to the third inlet hose 150. Specifically, in the illustrated embodiment, the pressure regulator 148 includes a pressure reducing regulator that is configured to reduce the pressure of water to a predetermined pressure at its output. In an alternative embodiment, the pressure regulator 148 may be any type of pressure regulator that enables the low flush toilet system 100 to operate as described herein. In the illustrated embodiment, the predetermined pressure is about 15 pounds per square inch (psi) to about 40 psi or about 30 psi.

The third inlet hose 150 is attached to the pressure regulator 148 and the T-splitter 152 and is configured to channel water from the pressure regulator 148 to the T-splitter 152. The T-splitter 152 is attached to the third inlet hose 150, the fourth inlet hose 154, and the fifth inlet hose 156 and is configured to channel water from the third inlet hose 150 to the fourth inlet hose 154 and the fifth inlet hose 156. The fourth inlet hose 154 is attached to the T-splitter 152 and the pressurized tank 110 and is configured to channel water from the T-splitter 152 to the pressurized tank 110. The fifth inlet hose 156 is attached to the T-splitter 152 and the float valve 158 and is configured to channel water from the T-splitter 152 to the float valve 158. The float valve 158 includes a float 160 that is attached to an on/off valve (not shown). When the level of the water in the gravity tank 108 meets or exceeds a predetermined level, the float 160 floats upward and turns off the on/off valve. In an alternative embodiment, the float valve 158 may be any type of float valve that enables the low flush toilet system 100 to operate as described herein.

During operations, the inlet 120 channels water from the water supply to the first inlet hose 142 and the first inlet hose 142 channels the water to the generator 144. The generator 144 receives the water and the water rotates the turbine and generates electricity. The generator 144 then channels the water to the second inlet hose 146 and the second inlet hose 146 channels the water to the pressure regulator 148. The pressure regulator 148 reduces the pressure of the water to the predetermined pressure and channels the water to the third inlet hose 150. The third inlet hose 150 channels the water to the T-splitter 152 and the T-splitter 152 channels water to the fourth inlet hose 154 and the fifth inlet hose 156. The fourth inlet hose 154 channels water to the pressurized tank 110 and the fifth inlet hose 156 channels water to the float valve 158. The float valve 158 channels water into the gravity tank 108 where the water is maintained at atmospheric pressure. Specifically, the gravity tank 108 is open to the atmosphere and the pressure of the water is reduced to atmospheric pressure when the float valve 158 discharges the water into the gravity tank 108. When the water in the gravity tank 108 reaches the predetermined level, the float 160 shuts off the float valve 158. The fifth inlet hose 156 channels the water into the pressurized tank 110 until the pressure of the water in the pressurized tank 110 equals the predetermined pressure such that the pressure prevents additional water from being channeled into the pressurized tank 110.

The evacuation system 114 is configured to drain the gravity tank 108, drain the pressurized tank 110, and fill the toilet bowl 102 with water from the gravity tank 108 and the pressurized tank 110. The evacuation system 114 includes a first outlet hose 162, a solenoid valve 164, a second outlet hose 166, a piston system 168, an outlet valve 170, the outlet pipe 128, and the outlet drain nut 118.

The first outlet hose 162 is attached to the pressurized tank 110 and the solenoid valve 164 and is configured to channel water from the pressurized tank 110 to the solenoid valve 164. The solenoid valve 164 is attached to the first outlet hose 162 and the second outlet hose 166 and is configured to channel water from the first outlet hose 162 and the second outlet hose 166. In the illustrated embodiment, the solenoid valve 164 includes an electrically controlled valve that includes a solenoid (an electric coil with a movable ferromagnetic core (plunger) in its center, not shown) that opens and closes a valve (not shown) within the solenoid valve 164 to control the flow of water from the first outlet hose 162 to the second outlet hose 166. In the illustrated embodiment, in a rest position, the plunger closes off a small orifice within the valve. An electric current through the coil creates a magnetic field that exerts an upwards force on the plunger opening the orifice. The solenoid valve 164 is controlled by the control system 116. In an alternative embodiment, the solenoid valve 164 may be any type of valve that enables the low flush toilet system 100 to operate as described herein. The second outlet hose 166 is attached to the solenoid valve 164 and the piston system 168 and is configured to channel water from the solenoid valve 164 to the piston system 168. As described below, the water from the second outlet hose 166 activates the piston system 168 such that pressurized water is channeled into the toilet bowl 102.

The piston system 168 includes a cylindrical shell 172, a piston 174, a hydraulic chamber 176, a first spring 178, a second spring 180, and a blast seal 182. The cylindrical shell 172 is attached to a bottom 184 of the pressurized tank 110 and a top 186 of the outlet valve 170 and defines a cylindrical cavity 188 therebetween. The cylindrical cavity 188 is configured to at least partially house the piston 174, the hydraulic chamber 176, the first spring 178, and the second spring 180 and is configured to channel pressurized water from a bottom opening 190 defined in the bottom 184 of the pressurized tank 110 to the outlet valve 170. The blast seal 182 is attached to the piston 174 and is positioned within the bottom opening 190 to seal the pressurized tank 110. The hydraulic chamber 176, the first spring 178, and the second spring 180 are attached to the piston 174 and are configured to raise and lower the piston 174 and the blast seal 182 to release the water in the pressurized tank 110 into the cylindrical cavity 188.

The hydraulic chamber 176 includes at least one wall 192 that defines an annular chamber 194 around the piston 174 and a plate 196 attached to the piston 174 that is sized and shaped to form a seal with the wall 192. In the illustrated embodiment, the at least one wall 192 comprises a plurality of walls 192 that define the annular chamber 194. The first spring 178 circumscribes a first portion 198 of the piston 174 and is configured to bias the piston 174 and the blast seal 182 upward such that the blast seal 182 opens the bottom opening 190 to release the water in the pressurized tank 110 into the cylindrical cavity 188. The second spring 180 circumscribes a second portion 200 of the piston 174 and is configured to bias the piston 174 and the blast seal 182 downward such that the blast seal 182 closes the bottom opening 190 to seal the water in the pressurized tank 110. The annular chamber 194 defines a water inlet 202 and a water outlet 204. The second outlet hose 166 is attached to the water inlet 202 and is configured to channel water from the solenoid 164 into the annular chamber 194 such that the plate 196 is pushed upward such that the blast seal 182 opens the bottom opening 190 to release the water in the pressurized tank 110 into the cylindrical cavity 188. The water then drains from the annular chamber 194 through the water outlet 204. The strength of the second spring 180 is greater than the strength of the first spring 178 such that the normal operating position of the blast seal 182 is within the bottom opening 190, sealing the water in the pressurized tank 110. The water from the solenoid valve 164 overcomes the force of the second spring 180 such that the plate 196 is pushed upward such that the blast seal 182 opens the bottom opening 190 to release the water in the pressurized tank 110 into the cylindrical cavity 188.

The outlet valve 170 is sized and shaped to fit within the internal cavity 140 beneath the piston system 168. Specifically, in the illustrated embodiment, the outlet valve 170 is substantially flat. In alternative embodiments, the outlet valve 170 may have any shape that enables the low flush toilet system 100 to operate as described herein. The outlet valve 170 includes an actuator (not shown) and a sliding plug (not shown) that prevents the flow of water from the internal cavity 140 and the cylindrical cavity 188 into the toilet bowl 102 when closed and enables the flow of water from the internal cavity 140 and the cylindrical cavity 188 into the toilet bowl 102 when open. The control system 116 controls the actuator which controls the slinging plug. In alternative embodiments, the outlet valve 170 may be any type of valve that enables the low flush toilet system 100 to operate as described herein.

During operations, when activated, the first outlet hose 162 channels water from the pressurized tank 110 to the solenoid valve 164, the solenoid valve 164 channels water from the first outlet hose 162 and the second outlet hose 166, and the second outlet hose 166 channels water from the solenoid valve 164 into the annular chamber 194. The outlet valve 170 is opened, permitting the flow of water from the internal cavity 140 into the toilet bowl 102. The water in the annular chamber 194 pushes the plate 196 and the blast seal 182 upward, opening the bottom opening 190 to release the water in the pressurized tank 110 into the cylindrical cavity 188, through the outlet valve 170, and into the toilet bowl 102. The solenoid valve 164 closes, preventing the flow of water from the pressurized tank 110 into the annular chamber 194 and closing the bottom opening 190. The outlet valve 170 closes, preventing the flow of water in the internal cavity 140 into the toilet bowl 102. The fill system 112 then refills the pressurized tank 110 and the gravity tank 108 as described above.

The control system 116 includes a computing device (not shown) and a battery (not shown) configured to control the solenoid valve 164 and the outlet valve 170 to control the low flush toilet system 100. The computing device and the battery are protected from water by a protective case 206. The computing device controls the timing of the solenoid valve 164 and the outlet valve 170. More specifically, the computing device controls when the outlet valve 170 opens and closes and controls when the solenoid valve 164 opens and closes.

For example, in some embodiments, the outlet valve 170 opens first, channeling atmospheric pressure water from the internal cavity 140 into the toilet bowl 102, removing at least some of the waste in the toilet bowl 102. The solenoid valve 164 then opens after a first predetermined amount of time such that pressurized water is channeled from the pressurized tank 110 into the annular chamber 194 such that the plate 196 and the blast seal 182 are pushed upward, opening the bottom opening 190 to release the water in the pressurized tank 110 into the cylindrical cavity 188 and the toilet bowl 102. The solenoid valve 164 then closes after a second predetermined amount of time, stopping the flow of pressurized water from the pressurized tank 110 into the annular chamber 194 such that the plate 196 and the blast seal 182 are pushed downward, closing the bottom opening 190. Finally, after a third predetermined amount of time, the outlet valve 170 is closed, preventing the flow of atmospheric pressure water from the internal cavity 140 into the toilet bowl 102.

The timing of first, second, and third predetermined amounts of time are fully customizable and determined based on unique conditions at the installation location. The first predetermined amount of time (solenoid valve 164 opening) is determined based on the amount of time necessary for the atmospheric pressure water from the internal cavity 140 water to completely fill the voids in the toilet rim 106. The second predetermined amount of time for the solenoid valve 164 to close is consistent across installation locations as the time it takes for the blast is consistent in every installation. The third predetermined amount of time (outlet valve 170 closing) is determined based on the amount of water necessary to complete the flush and to refill toilet bowl 102.

The first, second, and third predetermined amounts of time are determined based on the size of the toilet bowl 102. For example, larger toilet bowls may require longer first, second, and third predetermined amounts of time while smaller toilet bowls may require shorter first, second, and third predetermined amounts of time. In the illustrated embodiment, the first predetermined amount of time is about 2 seconds to about 5 seconds, the second predetermined amount of time is about 0.5 seconds to about 3 seconds, and the third predetermined amount of time is about 1 seconds to about 45 seconds. In alternative embodiments, the first, second, and third predetermined amounts of time may be any amount of time that enables the low flush toilet system 100 to operate as described herein.

Figure 6:
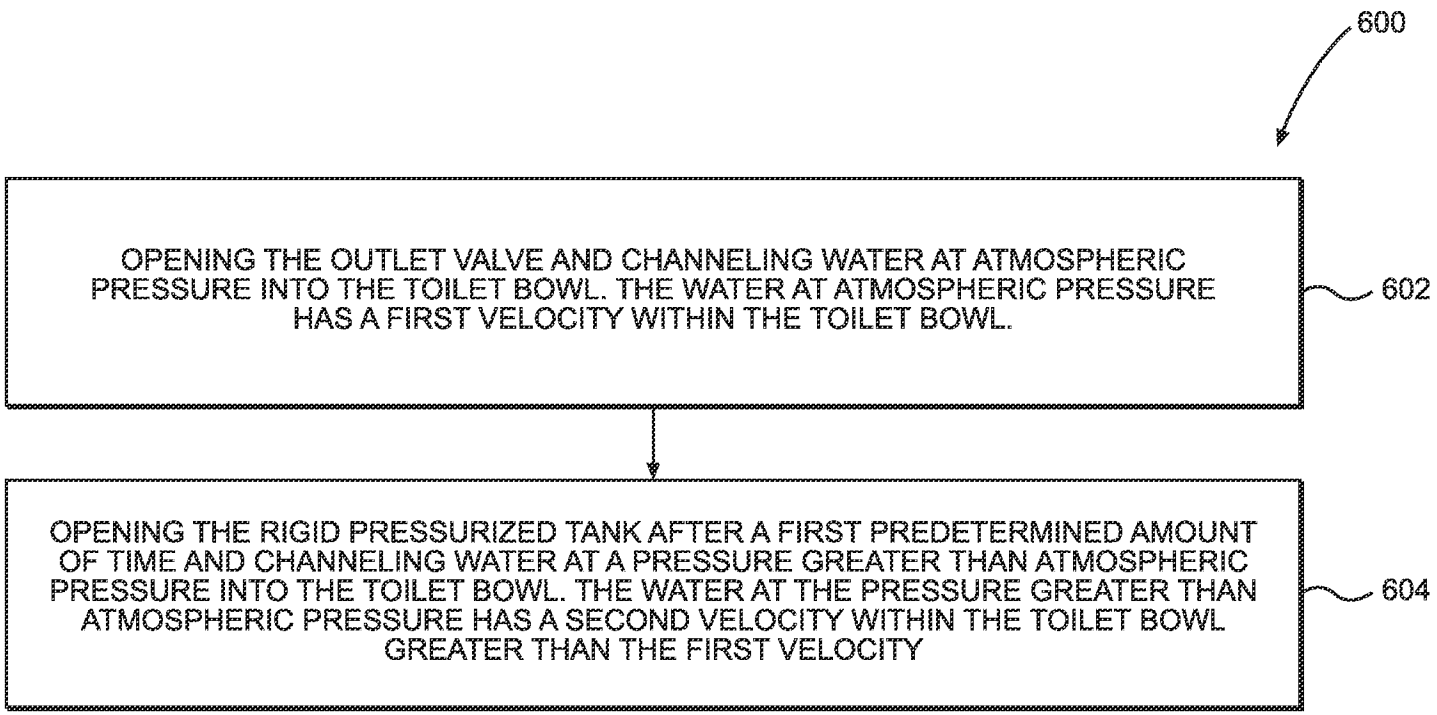
FIG. 6 illustrates a flow diagram of an example method of flushing a toilet in accordance with aspects of the present disclosure.

FIG. 6 is a flow diagram of a method 600 of flushing a toilet. The toilet includes a toilet bowl and a tank system. The tank system includes a gravity tank, a rigid pressurized tank positioned within the gravity tank, an outlet valve positioned within the gravity tank, and a piston assembly attached to the rigid pressurized tank and positioned within the gravity tank. The method 600 includes opening 602 the outlet valve and channeling water at atmospheric pressure into the toilet bowl. The water at atmospheric pressure has a first velocity within the toilet bowl. The method 600 also includes opening 604 the rigid pressurized tank after a first predetermined amount of time and channeling water at a pressure greater than atmospheric pressure into the toilet bowl. The water at the pressure greater than atmospheric pressure has a second velocity within the toilet bowl greater than the first velocity.

The disclosed technology includes pressure assist toilet flushing systems and methods. Specifically, in one implementation, a two-tank configuration (e.g., a gravity tank and a pressurized tank) can be applied to an existing toilet system and configured to perform a syphoning flush that uses less water than other pressure-assisted tanks due to a preloading operation of the flushing rim.

More specifically, the pressurized tank may be nested inside of the gravity tank. Further, the pressure tank and the gravity tank may be separate components. Once filled with water from a water supply, the gravity tank is released via the flushing rim of a toilet. The pressure tank includes water at a pressure greater than atmospheric pressure. Once the gravity tank has discharged via the flushing rim, the pressure tank is discharged, and the velocity of the pressurized water is greater than the velocity of the atmospheric water from the gravity tank. Thus, the water from the pressurized tank is more efficient at removing waste from a toilet bowl than typical toilets.

Additionally, the toilet system includes a piston system and a solenoid valve. The piston system is configured to open the pressurized tank using water from the pressurized tank. More specifically, when actuated, the solenoid valve channels pressurized water to the piston system and the piston system uses the water pressure to open the pressurized tank. Thus, the toilet systems described herein use the pressurized water to efficiently open the pressurized tank and more efficient at removing waste from a toilet bowl than typical toilets.

Finally, the toilet system includes an electric outlet valve, a control system, and a generator. The generator is configured to generate electricity that powers the electric outlet valve, the control system, and the solenoid valve. More specifically, the generator generates electricity from the flow of water from a water source. Thus, the toilet systems described herein electrically controls the toilet system without plugging the toilet system into an external source of electricity.

It should be noted that these methods describe examples of implementations, and that the operations and the steps may be rearranged or otherwise modified such that other implementations are possible. In some examples, aspects from two or more of the methods may be combined. For example, aspects of each of the methods may include steps or aspects of the other methods, or other steps or techniques described herein. Thus, aspects of the disclosure may provide for consumer preference and maintenance interface.

The description set forth herein, in connection with the appended drawings, describes example configurations and does not represent all the examples that may be implemented or that are within the scope of the claims. The term "exemplary" used herein means "serving as an example, instance, or illustration," and not "preferred" or "advantageous over other examples." The detailed description includes specific details for the purpose of providing an understanding of the described techniques. These techniques, however, may be practiced without these specific details. In the appended figures, similar components or features may have the same reference label.

The description herein is provided to enable a person skilled in the art to make or use the disclosure. Various modifications to the disclosure will be readily apparent to those skilled in the art, and the generic principles defined herein may be applied to other variations without departing from the scope of the disclosure. Thus, the disclosure is not limited to the examples and designs described herein but is to be accorded the broadest scope consistent with the principles and novel features disclosed herein.

What is claimed is:

1. A tank system comprising:

a gravity tank configured to contain water at atmospheric pressure;

a rigid pressurized tank positioned within the gravity tank and configured to contain water at a pressure greater than atmospheric pressure;

a piston assembly positioned below the rigid pressurized tank and configured to open and close the rigid pressurized tank, wherein the gravity tank is configured to channel water at atmospheric pressure into a toilet bowl at a first velocity and the rigid pressurized tank is configured to channel water at the pressure greater than atmospheric pressure into the toilet bowl at a second velocity, and wherein the second velocity is greater than the first velocity;

an outlet valve positioned below the piston assembly and configured to selectively channel water from the gravity tank and the pressurized tank into the toilet bowl; and a solenoid valve positioned within the gravity tank and configured to selectively channel water from the pressurized tank into the piston assembly.

2. The tank system of claim 1, further comprising a float valve positioned within the gravity tank and configured to selectively channel water from the water source into the gravity tank and the pressurized tank.

3. The tank system of claim 1, further comprising a pressure regulator positioned within the gravity tank and configured to reduce the pressure of water from the water source to a predetermined pressure.

4. The tank system of claim 1, further comprising a control system positioned within the gravity tank and configured to control the outlet valve and the solenoid valve.

5. The tank system of claim 4, further comprising a generator positioned within the gravity tank and configured to generate electricity from water from a water source and provide the generated electricity to the control system.

6. A toilet comprising:

a toilet bowl; and a tank system attached to the toilet bowl, the tank system comprises:

a gravity tank configured to contain water at atmospheric pressure;

a rigid pressurized tank positioned within the gravity tank and configured to contain water at a pressure greater than atmospheric pressure;

a piston assembly positioned below the rigid pressurized tank and configured to open and close the rigid pressurized tank, wherein the gravity tank is configured to channel water at atmospheric pressure into the toilet bowl at a first velocity and the rigid pressurized tank is configured to channel water at the pressure greater than atmospheric pressure into the toilet bowl at a second velocity, and wherein the second velocity is greater than the first velocity;

an outlet valve positioned below the piston assembly and configured to selectively channel water from the gravity tank and the pressurized tank into the toilet bowl; and a solenoid valve positioned within the gravity tank and configured to selectively channel water from the pressurized tank into the piston assembly.

7. The toilet of claim 6, further comprising a float valve positioned within the gravity tank and configured to selectively channel water from the water source into the gravity tank and the pressurized tank.

8. The toilet of claim 6, further comprising a pressure regulator positioned within the gravity tank and configured to reduce the pressure of water from the water source to a predetermined pressure.

9. The tank system of claim 6, further comprising a control system positioned within the gravity tank and configured to control the outlet valve and the solenoid valve.

10. The tank system of claim 9, further comprising a generator positioned within the gravity tank and configured to generate electricity from water from a water source and provide the generated electricity to the control system.

11. A method of flushing a toilet comprising a toilet bowl and a tank system comprising a gravity tank, a rigid pressurized tank positioned within the gravity tank, an outlet valve positioned within the gravity tank, and a piston assembly attached to the rigid pressurized tank and positioned within the gravity tank, the method comprising:

opening the outlet valve and channeling water at atmospheric pressure into the toilet bowl, wherein the water at atmospheric pressure has a first velocity within the toilet bowl; and opening the rigid pressurized tank after a first predetermined amount of time and channeling water at a pressure greater than atmospheric pressure into the toilet bowl, wherein the water at the pressure greater than atmospheric pressure has a second velocity within the toilet bowl greater than the first velocity, wherein the tank system further comprises a solenoid valve, and wherein the method further comprises channeling the water at the pressure greater than atmospheric pressure into the piston assembly to open the rigid pressurized tank.

12. The method of claim 11, further comprising closing the rigid pressurized tank after a second predetermined amount of time.

13. The method of claim 11, further comprising closing the outlet valve after a third predetermined amount of time.

14. The method of claim 11, wherein the tank system further comprises a float valve, and wherein the method further comprises refilling the gravity tank and the pressurized tank with the float valve.

15. The method of claim 11, wherein the tank system further comprises a control system and a generator, and wherein the method further comprises generating electricity to power the control system using the generator.

* * * * *